US008718518B2

(12) United States Patent
Egawa et al.

(10) Patent No.: US 8,718,518 B2
(45) Date of Patent: May 6, 2014

(54) DEVELOPMENT ROLL FOR ELECTROPHOTOGRAPHIC EQUIPMENT

(75) Inventors: Shuichi Egawa, Kasugai (JP); Masanari Umeda, Kani-gun (JP); Yousuke Hayashi, Kasugai (JP)

(73) Assignee: Tokai Rubber Industries, Ltd., Aichi (JP)

( * ) Notice: Subject to any disclaimer, the term of this patent is extended or adjusted under 35 U.S.C. 154(b) by 0 days.

(21) Appl. No.: 13/567,377

(22) Filed: Aug. 6, 2012

(65) Prior Publication Data

US 2012/0294656 A1 Nov. 22, 2012

Related U.S. Application Data

(63) Continuation of application No. PCT/JP2011/052235, filed on Feb. 3, 2011.

(30) Foreign Application Priority Data

Feb. 5, 2010 (JP) ..... 2010-023685

(51) Int. Cl.
*G03G 15/08* (2006.01)

(52) U.S. Cl.
USPC ..... 399/286; 492/18; 492/56

(58) Field of Classification Search
USPC ..... 399/265, 279, 286; 430/120; 492/18, 492/25, 48, 56, 59
See application file for complete search history.

(56) References Cited

U.S. PATENT DOCUMENTS

| | | | | |
|---|---|---|---|---|
| 5,903,808 | A * | 5/1999 | Takizawa et al. | 399/286 |
| 6,685,612 | B2 * | 2/2004 | Hirayama | 492/56 |
| 8,398,532 | B2 * | 3/2013 | Gopalanarayanan et al. | 492/56 |
| 2012/0294656 | A1 | 11/2012 | Egawa et al. | |

FOREIGN PATENT DOCUMENTS

| | | | |
|---|---|---|---|
| JP | 2009-180950 | A | 8/2009 |
| JP | 2009-186658 | A | 8/2009 |
| JP | 2010-32692 | A | 2/2010 |
| WO | 2011/096471 | A1 | 8/2011 |

OTHER PUBLICATIONS

International Search Report of PCT/JP2011/052235, mailing date Mar. 1, 2011.
Japanese Office Action dated Aug. 21, 2012, issued in corresponding Japanese Patent Application No. 2011-552818, (4 pages). With Partial English Translation.

* cited by examiner

*Primary Examiner* — Hoan Tran
(74) *Attorney, Agent, or Firm* — Westerman, Hattori, Daniels & Adrian, LLP

(57) ABSTRACT

A development roll for electrophotographic equipment includes a shaft body, a rubber elastic layer formed by molding on an outer circumference of the shaft body and having many convex portions formed by transfer molding on the outer circumferential surface thereof, and a coating layer disposed on an outer circumference of the rubber elastic layer. The coating layer is composed of a cured body of a coating material containing (A) a thermoplastic urethane having a number-average molecular weight in the range of 50,000 to 200,000, (B) a polyol having a number-average molecular weight in the range of 500 to 4,000, and (C) a curing agent. The mass percentages a, b, and c of the components (A), (B), and (C) satisfy the following expressions: $a+b+c=100$, $40 \leq a \leq 75$, $5 \leq b \leq 20$, and $20 \leq c$.

8 Claims, 3 Drawing Sheets

10

DEVELOPMENT ROLL FOR ELECTROPHOTOGRAPHIC EQUIPMENT

FIELD OF THE INVENTION

The present invention relates to a development roll for electrophotographic equipment.

BACKGROUND OF THE INVENTION

Examples of currently used electrophotographic equipment which employs an electrophotographic process include copiers, printers, and facsimile machines. A photosensitive drum is generally incorporated into the electrophotographic equipment, and conductive rolls, such as a development roll, a charging roll, a transfer roll, and a toner feed roll, are arranged around the photosensitive drum.

As a development roll for electrophotographic equipment, rolls having various structures are used. For example, a development roll includes a shaft body, a rubber elastic layer disposed on the outer circumference of the shaft body, and a coating layer disposed on the outer circumference of the rubber elastic layer. For the purpose of securing a high toner-conveying capability so as to enhance image quality and the like, the surface of the development roll may be formed to have an irregular shape in some cases.

Examples of a method for forming the surface of a development roll so as to have an irregular shape include a method in which resin particles composed of a urethane resin or the like are dispersed in a coating layer, and a method in which, using a cylindrical mold having many concave portions on the inner circumferential surface thereof, an irregular shape is transfer-molded onto the surface of a rubber elastic layer.

For example, Japanese Unexamined Patent Application Publication No. 2009-186658 discloses a method for forming an irregular shape by transfer molding on the surface of a rubber elastic layer. A coating layer (intermediate layer) is disposed on the outer circumference of the rubber elastic layer, and a coating material containing a thermoplastic urethane, a polyol, and a curing agent is used in order to form the coating layer.

Since convex portions of a rubber elastic layer formed by transfer molding are soft, the convex portions are apt to be broken by friction between an opposing member, such as a layer-forming blade, and side surfaces (sloping surfaces) of the convex portions of the rubber elastic layer. For example, in a development roll of Japanese Unexamined Patent Application Publication No. 2009-186658, breakage of the convex portions of the rubber elastic layer is caused under endurance conditions.

When the convex portions of the rubber elastic layer are broken in such a manner, the rubber elastic layer is exposed at the roll surface, and in sections in which the rubber elastic layer is exposed at the surface, the rubber elastic layer comes into contact with a photosensitive member. When the rubber elastic layer and the photosensitive member are in contact with each other, the constituents of the rubber elastic layer, which have bled out to the exposed surface, may be moved on and contaminate the photosensitive member, resulting in image defects, which is a problem.

SUMMARY OF THE INVENTION

A development roll for electrophotographic equipment is provided which can maintain a high toner-conveying capability over a long period of time and in which convex portions formed by transfer molding on the surface of a rubber elastic layer can be prevented from being broken.

The development roll for electrophotographic equipment includes a shaft body, a rubber elastic layer formed by molding on an outer circumference of the shaft body and having many convex portions formed by transfer molding on the outer circumferential surface thereof, and a coating layer disposed on an outer circumference of the rubber elastic layer. The coating layer is composed of a cured body of a coating material containing (A) a thermoplastic urethane having a number-average molecular weight in the range of 50,000 to 200,000, (B) a polyol having a number-average molecular weight in the range of 500 to 4,000, and (C) a curing agent. The mass percentages a, b, and c of the components (A), (B), and (C) in the coating material satisfy the expressions (1) to (4) below.

$$a+b+c=100 \quad (1)$$

$$40 \leq a \leq 75 \quad (2)$$

$$5 \leq b \leq 20 \quad (3)$$

$$20 \leq c \quad (4)$$

In this case, preferably, the thickness of the coating layer covering the convex portions of the rubber elastic layer is 1.5 μm or more. Furthermore, preferably, the height of irregularities on the roll surface is in the range of 1 to 25 μm. Furthermore, preferably, the height of the convex portions of the rubber elastic layer is in the range of 2 to 50 μm.

In the development roll for electrophotographic equipment, the coating material, which is used for forming the coating layer on the outer circumference of the rubber elastic layer having many convex portions formed by transfer molding on the outer circumferential surface thereof, contains (A) a specific thermoplastic urethane, (B) a specific polyol, and (C) a curing agent, and the mass percentages a, b, and c of the components (A), (B), and (C) in the coating material satisfy specific relationships. Consequently, the coating material has high thixotropy, and when the coating material is applied onto the outer circumference of the rubber elastic layer, it is possible to prevent a decrease in the thickness of the coating layer covering the sloping surfaces of the convex portions of the rubber elastic layer. Furthermore, since the mass percentages a, b, and c of the components (A), (B), and (C) in the coating material satisfy the specific relationships, the amount of addition of the component (C) is large compared with the component (B). Therefore, adhesion between the rubber elastic layer and the coating layer can be improved.

Thereby, the convex portions formed by transfer molding on the surface of the rubber elastic layer can be prevented from being broken by an opposing member, such as a layer-forming blade. Furthermore, since the irregular shape on the surface of the rubber elastic layer can be maintained over a long period of time, it is possible to maintain a high toner-conveying capability over a long period of time.

In this case, when the thickness of the coating layer covering the convex portions of the rubber elastic layer is 1.5 μm or more, the thickness of the coating layer covering the side surfaces (sloping surfaces) of the convex portions is sufficiently secured. Therefore, a high effect of preventing breakage of the convex portions of the rubber elastic layer can be obtained.

Furthermore, in this case, when the height of irregularities on the roll surface is in the range of 1 to 25 μm, in particular, an excellent toner-conveying capability is exhibited. Since the irregular shape having an excellent toner-conveying capability can be maintained without being broken oven a long period of time, a high toner-conveying capability can be maintained over a long period of time.

Furthermore, in this case, when the height of the convex portions of the rubber elastic layer is in the range of 2 to 50 μm, the height of irregularities on the roll surface can be controlled within a specific range, resulting in an excellent toner-conveying capability. Since the irregular shape having an excellent toner-conveying capability can be maintained without being broken oven a long period of time, a high toner-conveying capability can be maintained over a long period of time.

DESCRIPTION OF THE PREFERRED EMBODIMENTS

A development roll for electrophotographic equipment (hereinafter, may be referred to as "development roll") according to an embodiment of the present invention will be described in detail below with reference to the drawings. A development roll for electrophotographic equipment is installed in electrophotographic equipment, such as a copier, printer, or facsimile machine, which employs an electrophotographic process, and is arranged around a photosensitive drum installed inside the electrophotographic equipment.

Figure 1:
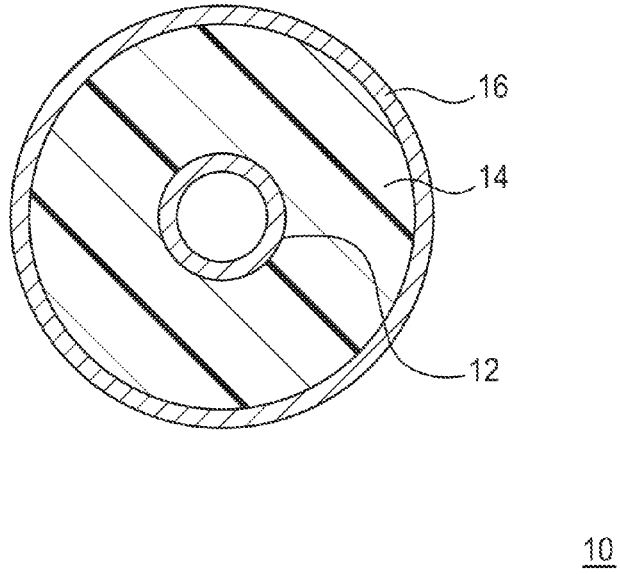
FIG. 1 is a cross-sectional view, taken in a circumferential direction, showing a development roll for electrophotographic equipment according to an embodiment of the present invention.

FIG. 1 is a cross-sectional view, taken in a circumferential direction, showing a development roll 10 according to an embodiment. As shown in FIG. 1, the development roll 10 includes a shaft body 12, a rubber elastic layer 14 disposed on the outer circumference of the shaft body 12, and a coating layer 16 disposed on the outer circumference of the rubber elastic layer 14.

As the shaft body 12, a conductive shaft may be used. Examples of the conductive shaft include a solid body made of metal, a cylindrical body made of metal, and these bodies subjected to plating. Examples of the metal include aluminum and stainless steel. An adhesive, primer, or the like may be applied onto the outer circumferential surface of the shaft body 12 in order to improve adhesion with the rubber elastic layer 14. The adhesive, primer, or the like may be imparted with conductivity, as necessary.

Figure 2:
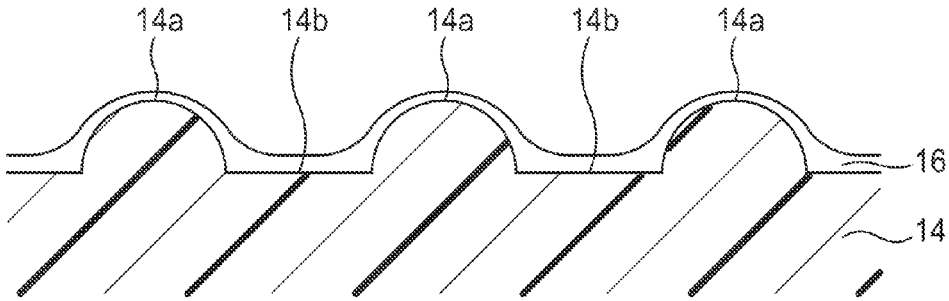
FIG. 2 is an enlarged sectional-view showing a roll surface of the development roll for electrophotographic equipment.

The rubber elastic layer 14 serves as a base layer of the development roll 10. FIG. 2 is an enlarged view showing the roll surface. The rubber elastic layer 14 will be described in detail with reference to FIG. 2. The rubber elastic layer 14 has many convex portions 14*a* on the outer circumferential surface thereof. A flat portion 14*b* lies between two adjacent convex portions 14*a*. Each of the flat portions 14*b* includes a surface substantially parallel to the outer circumferential surface of the shaft body 12, and the convex portions 14*a* protrude outside in the radial direction from the flat portions 14*b*. In such a manner, the rubber elastic layer 14 has an irregular shape including the convex portions 14*a* and the flat portions 14*b* on the outer circumferential surface thereof.

The rubber elastic layer 14 is formed by molding on the outer circumference of the shaft body 12 using a cylindrical mold. The inner circumferential surface of the mold (i.e., the surface to be brought into contact with the outer circumferential surface of the rubber elastic layer 14 during molding) is provided in advance with many concave portions. A flat portion of the mold, which includes a surface to be substantially parallel to the outer circumferential surface of the shaft body 12, lies between two adjacent concave portions of the mold. The inner circumferential surface of the mold has an irregular shape including the concave portions and the flat portions. Accordingly, when the rubber elastic layer 14 is formed by molding, the irregular shape of the inner circumferential surface of the mold is transferred to the outer circumferential surface of the rubber elastic layer 14. In such a manner, many convex portions 14*a* are formed on the outer circumferential surface of the rubber elastic layer 14 by transfer molding using the mold.

Specific examples of the rubber material for the rubber elastic layer 14 include silicone rubber, urethane rubber, butadiene rubber, and hydrin rubber. Among these, silicone rubber and urethane rubber are preferable in terms of excellent recovery from elastic deformation due to pressing of an opposing member, such as a layer-forming blade or photosensitive member (good resistance to becoming permanently set). Furthermore, silicone rubber is advantageous in that its volume is not likely to change with changes in the environment, such as changes in temperature and humidity, and the variation in the outside diameter of the roll due to changes in the environment is small, and therefore is particularly preferable.

As necessary, the rubber elastic layer 14 may be incorporated with appropriate amounts of additives, such as a conductive agent, a filler, a bulking agent, a reinforcing agent, a processing aid, a curing agent, a vulcanization accelerator, a crosslinking agent, a crosslinking coagent, an antioxidant, a plasticizer, an ultraviolet light absorber, a pigment, silicone oil, an auxiliary, and a surfactant. The conductive agent may be a commonly used one, such as an electronically conductive agent (e.g., carbon black) or an ionically conductive agent (e.g., a quaternary ammonium salt).

The rubber elastic layer 14 may be a foamed body or solid body. The thickness of the rubber elastic layer 14 is preferably in the range of 0.1 to 10 mm, and more preferably in the range of 1 to 5 mm.

The coating layer 16 is composed of a cured body of a coating material containing (A) a thermoplastic urethane, (B) a polyol, and (C) a curing agent. A thermosetting urethane is formed by reaction between the component (B) and the component (C), and the cured body is obtained. Since the coating layer 16 is formed of a material containing a thermoplastic urethane and a thermosetting urethane, it is possible to achieve both the property of being less likely to become permanently set (i.e., becoming hard) and reduction in cure shrinkage.

The thermoplastic urethane (A) can have a number-average molecular weight in the range of 50,000 to 200,000 in view of ease of application of the coating material, and the like. Examples of the thermoplastic urethane include caprolactam-type, adipate-type, and ether-type ones. Among these, a caprolactone-type thermoplastic urethane is preferable from the standpoint of securing high mechanical strength, elastic recovery, and the like. Thereby, it is possible to obtain high mechanical strength while maintaining low hardness. The number-average molecular weight of the thermoplastic urethane is determined by gel permeation chromatography (GPC) using a polystyrene standard curve.

The polyol (B) can have a number-average molecular weight in the range of 500 to 4,000 from the standpoint of enhancing thixotropy of the coating material, and the like. Examples of the polyol include an ether-based polyol, a caprolactone-based polyol, and an ester-based polyol. Among these, the ether-based polyol is preferable in view of reduction of resistance. When the resistance is reduced, the image retention property is improved. The number-average molecular weight of the polyol is determined by gel permeation chromatography (GPC) using a polystyrene standard curve.

Examples of the ether-based polyol include a polyether polyol obtained by addition polymerization of at least one polyhydric alcohol having a relatively low molecular weight and at least one of ethylene oxide, propylene oxide, butylene oxide, and the like; and polytetramethylene ether glycol (PTMEG) obtained by ring-opening polymerization of tetrahydrofuran.

Examples of the polyhydric alcohol include aliphatic glycols, such as ethylene glycol, propylene glycol, 1,3-propane diol, 1,4-butane diol, 1,5-pentane diol, 1,6-hexane diol, 1,2-propylene glycol, 1,3-propylene glycol, 1,3-butylene glycol, 2,3-butylene glycol, 2,2-dimethyl-1,3-propane diol, 3-methyl-1,5-pentane diol, 2,2-dimethyl-3-hydroxypropyl-2',2'-dimethyl-3-hydroxypropanate, and 2,2-diethyl-1,3-propanediol; and alicyclic glycols, such as 1,3-bis(hydroxymethyl)cyclohexane, 1,4-bis(hydroxymethyl)cyclohexane, 1,4-bis(hydroxyethyl)cyclohexane, 1,4-bis(hydroxypropyl)cyclohexane, 1,4-bis(hydroxymethoxy)cyclohexane, 1,4-bis(hydroxyethoxy)cyclohexane, 2,2-bis(4-hydroxymethoxycyclohexyl)propane, 2,2-bis(4-hydroxyethoxycyclohexyl)propane,bis(4-hydroxycyclohexyl)methane, 2,2-bis(4-hydroxycyclohexyl)propane, and 3(4),8(9),tricycle[5.2.1.02,6]decane dimethanol. Among these, in particular, ethylene glycol, 2,2-dimethyl-1,3-propane diol, 1,6-hexane diol, and 1,4-bis(hydroxymethyl)cyclohexane are preferable.

Examples of an acid component of the ester-based polyol include aliphatic dibasic acids, such as succinic acid, adipic acid, azelaic acid, sebacic acid, dodecanedicarboxylic acid, and dodecylsuccinic acid; alicyclic dibasic acids, such as 1,2-cyclohexanedicarboxylic acid, 1,3-cyclohexanedicarboxylic acid, 1,4-cyclohexanedicarboxylic acid, 4-methyl-1,2-cyclohexanedicarboxylic acid, 1,2-bis(4-carboxycyclohexyl)methane, and 2,2-bis(4-carboxycyclohexyl)propane; and aromatic dibasic acids, such as terephthalic acid, isophthalic acid, orthophthalic acid, and 1,6-naphthalenedicarboxylic acid. Alicyclic dibasic acids and aromatic dibasic acids improve the cohesive strength of resin, while aliphatic dibasic acids tend to improve flexibility of resin.

As the curing agent (C), an isocyanate may be used. Examples of the isocyanate include an isocyanate having one isocyanate group in its molecule, a diisocyanate having two isocyanate groups in its molecule, and an isocyanate having three or more isocyanate groups in its molecule. Specific examples thereof include aromatic diisocyanates, such as 2,4-tolylene diisocyanate, 2,6-tolylene diisocyanate, p-phenylene diisocyanate, 4,4'-diphenylmethane diisocyanate (MDI), m-phenylene diisocyanate, 3,3'-dimethoxy-4,4'-biphenylene diisocyanate, 2,6-naphthalene diisocyanate, 3,3'-dimethyl-4,4'-biphenylene diisocyanate, 4,4'-diphenylene diisocyanate, 4,4'-diisocyanate diphenyl ether, 1,5-naphthalene diisocyanate, and m-xylene diisocyanate; and aliphatic and alicyclic diisocyanates, such as hydrogenated products of 1,6-hexane diisocyanate, isophorone diisocyanate, and 4,4'-diphenylmethane diisocyanate. Among these, 4,4'-diphenylmethane diisocyanate (MDI) is particularly preferable.

The isocyanate used as the curing agent needs to have at least one isocyanate group that can react with the polyol (B). Therefore, in an isocyanate having two or more isocyanate groups in its molecule, any isocyanate group other than the one or more isocyanate groups used for the reaction with the polyol may be modified. Examples of the modified isocyanate include polypropylene glycol-modified MDI (PPG-modified MDI).

Regarding the composition ratio of the components (A), (B), and (C) in the coating material, the mass percentages of the components (A), (B), and (C) satisfy the expressions (1) to (4) below, where a is the mass percentage of the component (A), b is the mass percentage of the component (B), and c is the mass percentage of the component (C).

$$a+b+c=100 \quad (1)$$

$$40 \leq a \leq 75 \quad (2)$$

$$5 \leq b \leq 20 \quad (3)$$

$$20 \leq c \quad (4)$$

Figure 3:
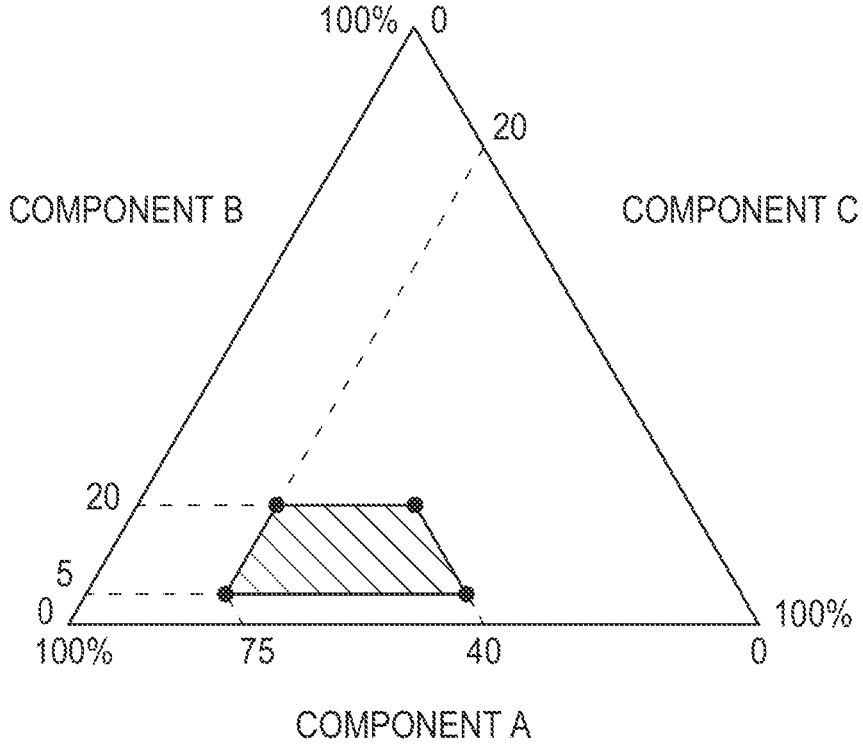
FIG. 3 is a ternary diagram showing the mass percentages of components (A), (B), and (C) in a coating material for forming a coating layer.

FIG. 3 is a ternary diagram showing these relationships. The mass percentages a, b, and c fall within the region (shaded region in FIG. 3) surrounded by lines connecting the points (60,20,20), (75,5,20), (40,5,55), and (40,20,40) in the ternary diagram. Note that a point in the ternary diagram is represented by (a,b,c).

Since the mass percentages a, b, and c of the components (A), (B), and (C) in the coating material fall within such a specific region, the thixotropy of the coating material increases. As a result, when the coating material is applied onto the outer circumference of the rubber elastic layer, it is possible to prevent a decrease in the thickness of the coating layer covering the sloping surfaces of the convex portions of the rubber elastic layer. Furthermore, since the mass percentages a, b, and c of the components (A), (B), and (C) in the coating material satisfy such specific relationships, the amount of addition of the component (C) is large compared with the component (B). Therefore, adhesion between the rubber elastic layer and the coating layer is improved. Accordingly, since the coating layer is prevented from being scraped by an opposing member, such as a layer-forming blade, the convex portions formed by transfer molding on the surface of the rubber elastic layer can be prevented from being broken by the opposing member. Furthermore, since the irregular shape on the surface of the rubber elastic layer can be maintained over a long period of time, it is possible to maintain a high toner-conveying capability over a long period of time.

As necessary, components other than the components (A), (B), and (C) may be added to the coating material. Examples of the other components include a solvent, a conductive agent, a plasticizer, and a leveling agent. Examples of the solvent include methyl ethyl ketone (MEK), methanol, toluene, isopropyl alcohol, methyl cellosolve, and dimethylformamide.

In the case where the coating material contains a solvent, the amount of the solvent can be appropriately set, within the range that does not affect the thixotropy of the coating material, so as to enhance a coating property of the coating material, and according to the type of the solvent. For example, the amount of the solvent may be 10 parts by mass or more, 50 parts by mass or more, or 100 parts or more relative to 100 parts by mass of the total amount of the components (A), (B), and (C) in the coating material, and may be 1,000 parts by mass or less, 800 parts by mass or less, or 500 parts by mass of less relative to 100 parts by mass of the total amount of the components (A), (B), and (C) in the coating material.

The viscosity of the coating material is not particularly limited, and, for example, may be 500 mPa·s or less, 300 mPa·s or less, or 100 mPa·s or less. The viscosity may be 10 mPa·s or more. The viscosity of the coating material can be measured using a viscometer (e.g., Brookfield type viscometer).

Figure 4:
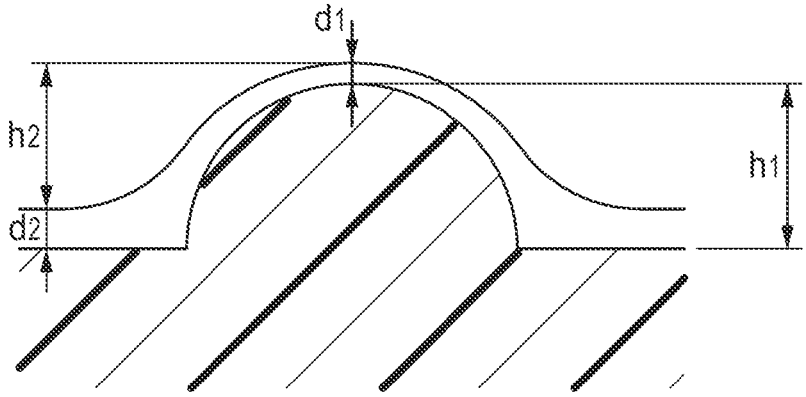
FIG. 4 is a further enlarged cross-sectional view showing the roll surface of the development roll for electrophotographic equipment shown in FIG. 2.

An irregular shape due to the convex portions 14*a* of the rubber elastic layer 14 is formed on the roll surface covered with the coating layer 16 composed of a cured body of the coating material. The irregular shape is preferably a specific irregular shape from the standpoint of securing a high toner-conveying capability, and the like. More specifically, the height of irregularities on the roll surface is preferably in the range of 1 to 25 μm, and more preferably in the range of 3 to 20 μm. As shown in FIG. 4, the height of irregularities on the roll surface can be expressed as a difference in height (h2) between the convex portion and the concave portion on the roll surface.

Regarding the thickness of the coating layer 16 composed of the cured body of the coating material, the thickness (d1) of the coating layer 16 at the section covering the convex portions 14*a* of the rubber elastic layer 14 is preferably 1.5 μm or more, more preferably 2.5 μm or more, and still more preferably 3.5 μm or more. When the thickness (d1) is 1.5 μm or more, the thickness of the coating layer 16 covering the side surfaces (sloping surfaces) of the convex portions 14*a* is sufficiently secured. Therefore, a high effect of preventing breakage of the convex portions 14*a* of the rubber elastic layer 14 can be obtained. On the other hand, when the thickness (d1) is too large, the irregular shape due to the convex portions 14*a* of the rubber elastic layer 14 becomes difficult to appear at the roll surface. Therefore, from the standpoint of securing the toner-conveying capability, and the like, the thickness (d1) is preferably 7 μm or less, and more preferably 5 μm or less.

Furthermore, the thickness (d2) of the coating layer at the section covering the flat portions 14*b* of the rubber elastic layer 14 is preferably in the range of 8 to 16 μm, and more preferably in the range of 10 to 14 μm. When the thickness (d2) is 8 μm or more, the thickness (d1) at the section covering the convex portions 14*a* can be sufficiently secured. On the other hand, when the thickness (d2) is 16 μm or less, the irregular shape due to the convex portions 14*a* of the rubber elastic layer 14 can be sufficiently secured.

The height (h1) of the convex portions 14*a* of the rubber elastic layer 14 is preferably in the range of 2 to 50 μm, and more preferably in the range of 5 to 30 μm. When the height (h1) of the convex portions 14*a* is in the range of 2 to 50 μm, the height of irregularities on the roll surface can be set within a specific range, and therefore an excellent toner-conveying capability can be obtained. Note that the height (h1) of the convex portion 14*a* of the rubber elastic layer 14 can be expressed as a difference between the height of the flat portion 14*b* and the height at the apex of the convex portion 14*a*.

The thickness (d1) of the coating layer 16 covering the convex portions 14*a* of the rubber elastic layer 14, the thickness (d2) of the coating layer 16 covering the flat portions 14*b*, the height of irregularities (h2) on the roll surface, the height (h1) of the convex portions 14*a* of the rubber elastic layer 14, and the like can be measured using a laser microscope (e.g., VK-9510 manufactured by Keyence Corporation) that can observe a cross section cut in the circumferential direction of the development roll 10 such as that shown in FIG. 4.

Furthermore, the number density of the convex portions 14*a* in the outer circumferential surface of the rubber elastic layer 14 is preferably in the range of 50 to 1,000 pieces/mm$^2$ from the standpoint of securing the toner-conveying capability, improving the definition of image, and the like. The number density of the convex portions 14*a* can be measured using a laser microscope (e.g., VK-9510 manufactured by Keyence Corporation) that can observe the outer circumferential surface of the rubber elastic layer 14 of the development roll 10.

A method of manufacturing a development roll 10 will be described below.

First, a rubber elastic layer 14 is formed on the outer circumference of the shaft body 12. More specifically, for example, the shaft body 12 is set in a hollow portion of a cylindrical mold, and a rubber material is cast into a void between the cylindrical mold and the shaft body 12 and is crosslinked by heating, followed by demolding from the cylindrical mold. Thereby, the rubber elastic layer 14 is formed on the outer circumference of the shaft body 12. As the cylindrical mold, a mold having many concave portions on the inner circumferential surface thereof is used. By forming the rubber elastic layer 14 by molding using the cylindrical mold, the irregular shape on the inner surface of the cylindrical mold is transferred onto the outer circumferential surface of the rubber elastic layer 14.

Next, a coating layer 16 is formed on the outer circumference of the rubber elastic layer 14. More specifically, a coating material containing (A) a thermoplastic urethane, (B) a polyol, and (C) a curing agent is applied onto the outer circumferential surface of the rubber elastic layer 14. The applied coating material is dried and crosslinked by heating to thereby form the coating layer 16 on the outer circumference of the rubber elastic layer 14. Thus, a development roll 10 is obtained.

Examples of the method for forming many concave portions on the inner circumferential surface of the cylindrical mold include a method in which the inner circumferential surface of the cylindrical mold is subjected to shot blasting, a method in which the inner circumferential surface of the cylindrical mold is subjected to electro-discharge machining, and a method in which the inner circumferential surface of the cylindrical mold is subjected to electroless composite plating, and pits (defects of plating) are formed on the surface of the electroless composite plating layer. Among these, the method in which pits are formed on the surface of the electroless composite plating layer is preferable from the standpoint that concave portions can be deepened, and the size of the convex portions 14*a* of the rubber elastic layer 14 can be further increased.

In order to form pits (defects of plating) on the surface of the electroless composite plating layer, poor electroless composite plating is performed intentionally. Pits are formed because hydrogen gas generated during the plating reaction adsorbs to the surface of deposited plating, and further plating deposition is blocked in portions where adsorption has occurred. The concave of each of the pits usually has a curved shape corresponding to a part of a substantially spherical surface (e.g., semispherical shape).

Examples of the metal used in electroless composite plating include nickel, cobalt, copper, tin, palladium, gold, and alloys of these metals. Among these, nickel or a nickel alloy is preferable in view of ease of forming pits.

As the electroless composite plating, electroless composite plating of particle dispersion type is preferable from the standpoint that the distribution density of pits can be easily made more uniform. Preferably, the dispersion particles have an average particle size in the range of 0.1 to 5 μm. In this case, uniform dispersibility of dispersion particles in the plating bath and uniform codeposition in the electroless composite plating player are improved. Thereby, the surface of the electroless composite plating layer can be formed into a more uniform rough surface.

Examples of the material constituting the dispersion particles include silicon carbide (SiC), aluminum oxide ($Al_2O_3$), zirconium oxide ($ZrO_2$), titanium oxide ($TiO_2$), polytetrafluoroethylene (PTFE), and boron nitride (BN). Among these, PTFE is preferable in terms of excellent releasability from a rubber material to be cast.

Preferably, the plating bath is incorporated with a hydrocarbon-based cationic surfactant or amphoteric surfactant from the standpoint that hydrogen gas generated during the plating reaction is made to more easily adsorb to the surface and formation of pits can be facilitated.

The coating 16 may further contain surface roughness forming particles that form roughness on the roll surface. As such surface roughness forming particles, for example, polyurethane beads or the like may be used. The polyurethane beads are preferably flexible.

Furthermore, a surface protection layer may be further provided on the outer circumference of the coating layer 16 for the purpose of protecting the roll surface and the like. The thickness of the surface protection layer is preferably in the range of 1 to 20 μm. When the thickness of the surface protection layer is in this range, the function of protecting the roll surface can be fully exhibited and the irregular shape due to the convex portions 14*a* of the rubber elastic layer 14 can be maintained. In the case where a surface protection layer is provided on the outer circumferential surface of the coating layer 16, the outermost layer of the development roll is the surface protection layer, and thus the surface (outer circumferential surface) of the surface protection layer corresponds to the roll surface.

Examples of the surface protection layer include a urethane resin, an acrylic resin, a silicone-modified urethane resin, and a silicone-modified acrylic resin. The material constituting the surface protection layer may contain one or two or more additives, such as a conductive agent (electronically conductive agent and/or ionically conductive agent), a plasticizer, and a leveling agent. The material for the surface protection layer is preferably in a liquid form prepared, as necessary, using a solvent, such as MEK. The amount of the solvent is not particularly limited, and is preferably 10 to 1,000 parts by mass, and more preferably 100 to 800 parts by mass relative to 100 parts by mass of the main component, such as a urethane resin, in terms of ease of coating and the like.

The surface protection layer can be formed, for example, by applying a material for the surface protection layer onto the outer circumferential surface of the coating layer. The application method is not particularly limited, and a commonly used method, such as dipping, spraying, or roll coating, may be employed. After the application of the material for the surface protection layer, as necessary, drying, crosslinking by heating, and the like are performed. Thereby, a surface protection layer is formed.

Furthermore, instead of forming a surface protection layer on the outer circumference of the coating layer 16, the surface of the coating layer 16 may be modified. Examples of the method of surface modification for the coating layer 16 include 1) surface modification by ultraviolet irradiation, 2) surface modification using a surface modifier containing trichloroisocyanuric acid, 3) surface modification using a surface modifier containing a compound having two or more thiol groups, such as trithiocyanuric acid, and 4) surface modification by halogenation.

In the case of performing the surface modification 1), as the ultraviolet irradiation apparatus, any known ultraviolet irradiation apparatus can be used. Specifically, for example, UB031-2A/BM (trade name) manufactured by Eye Graphics Co., Ltd. can be used. Conditions for ultraviolet irradiation are appropriately set depending on the type of the ultraviolet irradiation apparatus used and the like. In general, ultraviolet irradiation is performed under the following conditions: irradiation intensity, about 20 to 150 mW/cm$^2$; distance between ultraviolet light source and surface of elastic layer, about 20 to 80 mm; and irradiation time, about 5 to 360 seconds.

The surface modification 4) can be performed by bringing a compound, such as an alkyl hypohalide, hypochlorite, acid imide halide compound, isocyanuric halide, or halogenated hydantoin, into contact with BF3.

EXAMPLES

The present invention will be described in more detail below on the basis of examples. It is to be understood that the present disclosure is not limited thereto.

Example 1

<Preparation of Rubber Elastic Layer Composition>

A rubber elastic layer composition was prepared by mixing a conductive liquid silicone rubber ("X34-264A/B" manufactured by Shin-Etsu Chemical Co., Ltd.) using a static mixer.

<Preparation of Coating Layer Composition>

64 parts by mass of a thermoplastic urethane elastomer (thermoplastic urethane component, "Elastollan" manufactured by BASF Japan Ltd., number-average molecular weight 100,000), 16 parts by mass of an ether-based polyol (polyol component, "PPG2000" manufactured by Sanyo Chemical Industries, Ltd., number-average molecular weight 2,000), 20 parts by mass of an isocyanate (curing agent component, "Millionate MT" manufactured by DIC Corporation, MDI), 30 parts by mass of an electronically conductive agent ("DENKA BLACK" manufactured by Denki Kagaku Kogyo Kabushiki Kaisha), and 1 part by mass of an ionically conductive agent (quaternary ammonium salt) were kneaded using a ball mill, and 400 parts by mass of MEK was added thereto, followed by mixing and stirring to prepare a coating layer composition (coating material).

<Production of Cylindrical Mold>

A plating bath with pH 4.8 was prepared by mixing 20 g/l of nickel sulfate-6-hydrate, 25 g/l of sodium hypophosphite monohydrate (reducing agent), 27 g/l of lactic acid (complexing agent), 2.5 g/l of propionic acid (complexing agent), 5 g/l of dispersion particles formed of PTFE (average particle size 0.2 μm), and 0.1 g/l of lauryl trimethyl ammonium chloride (cationic surfactant).

By immersing a cylindrical mold base material in the plating bath, poor electroless composite plating was performed on the inner surface of the cylindrical mold base material to obtain a cylindrical mold (inside diameter 12 mm) having a surface of an electroless composite plating layer, which served as a mold surface, in which many pits were uniformly distributed. In this process, the temperature of the plating bath was set at 90° C., the plating time was set at 120 minutes, and the thickness of the electroless composite plating layer was set to be 22 μm. The ten-point mean roughness (Rz) of the surface of the electroless composite plating layer was 10 μm. Note that the ten-point mean roughness (Rz) was measured using a surface roughness meter (Surfcom 1400D manufactured by Tokyo Seimitsu Co., Ltd).

<Production of Development Roll>

A conductive shaft (diameter 6 mm, length 270 mm) was coaxially set inside the cylindrical mold thus produced, and the prepared rubber elastic layer composition was poured into the mold. Heating was performed at 150° C. for 30 minutes, followed by cooling and demolding. Thereby, a roll body including the conductive shaft having a rubber elastic layer with a thickness of 3 mm on the outer circumference thereof was obtained. The rubber elastic layer thus obtained had many convex portions formed by transfer molding on the outer circumferential surface thereof, the convex portions corresponding to the concave portions provided on the inner surface of the cylindrical mold. Next, the surface of the roll body was coated by roll coating with a prepared coating layer composition, and then, heat treatment was performed at 170° C. for 60 minutes to form a coating layer with a thickness of 12 μm. In such a manner, a development roll according to Example 1 was produced.

Examples 2 to 7

Development rolls according to Examples 2 to 7 were produced as in Example 1 except that the composition ratio of the thermoplastic urethane, the polyol, and the isocyanate was set as shown in Table 1 in the preparation of the coating layer composition.

Examples 8 and 9

Development rolls according to Examples 8 and 9 were produced as in Example 2 except that the height of irregularities on the roll surface was changed by adjusting the amount of application of the coating layer composition (coating material) while maintaining the same composition ratio of the coating layer composition as that of Example 2.

Comparative Examples 1 to 3

Development rolls according to Comparative Examples 1 to 3 were produced as in Example 1 except that the composition ratio of the thermoplastic urethane, the polyol, and the isocyanate was set as shown in Table 1 in the preparation of the coating layer composition.

Examples 10 and 11

Development rolls according to Examples 10 and 11 were produced as in Example 2 except that the thermoplastic urethane was changed to thermoplastic urethane elastomers having different number-average molecular weights in the preparation of the coating layer composition. The thermoplastic urethane components used are described below.

Example 10

"Elastollan" manufactured by BASF Japan Ltd., number-average molecular weight 50,000

Example 11

"Elastollan" manufactured by BASF Japan Ltd., number-average molecular weight 200,000

Examples 12 and 13

Development rolls according to Examples 12 and 13 were produced as in Example 2 except that the polyol was changed to polyols having different number-average molecular weights in the preparation of the coating layer composition. The polyol components used are described below.

Example 12

"PPG500" manufactured by Sanyo Chemical Industries, Ltd., number-average molecular weight 500

Example 13

"PPG4000" manufactured by Sanyo Chemical Industries, Ltd., number-average molecular weight 4,000

Example 14

<Preparation of Surface Protection Layer Composition>

A thermoplastic urethane resin X with a glass transition temperature Tg of 20° C. and a thermoplastic urethane resin Y with a glass transition temperature Tg of 100° C. (both of which are a "Vylon UR series" manufactured by Toyobo Co., Ltd.) were mixed at a mixing ratio X/Y (by mass) of 50/50. 20 parts by mass of an electronically conductive agent ("DENKA BLACK" manufactured by Denki Kagaku Kogyo Kabushiki Kaisha) and 1 part by mass of an ionically conductive agent (quaternary ammonium salt) were further added to 100 parts by mass of the mixture of the thermoplastic urethane resins, followed by kneading with a ball mill. Next, 400 parts by mass of MEK was added to the kneaded product, followed by mixing and stirring. Thereby, a surface protection layer composition was prepared. The tensile storage modulus E' of the resulting surface protection layer composition was $7.0\times10^9$ Pa at 10° C. and $2.0\times10^9$ Pa at 50° C. Note that the glass transition temperature Tg of the thermoplastic urethane resins was determined according to JIS K7121 "Measuring methods for transition temperatures of plastics". Furthermore, the tensile storage modulus E' of the surface protection layer composition was determined according to JIS K7244-4 "Plastics—Testing methods of dynamic mechanical properties—Part 4: Tensile vibration-Non-resonance method".

<Production of Development Roll>

The surface of the coating layer of a development roll having the same structure as that of Example 2 was coated by roll coating with the surface protection layer composition, and then, heat treatment was performed at 170° C. for 60 minutes to form a surface protection layer with a thickness of 9 μm. Thereby, a development roll according to Example 14 was produced.

Example 15

A development roll according to Example 15 was produced as in Example 2 except that surface modification by ultraviolet irradiation was performed on the surface of the coating layer of a development roll having the same structure as that of Example 2. The surface modification by ultraviolet irradiation was performed, using an ultraviolet irradiation apparatus "UB031-2A/BM" (mercury lamp type) manufactured by Eye Graphics Co., Ltd., while rotating the roll body at a peripheral speed of 570 to 590 mm/sec, under the following conditions: irradiation intensity, 120 mW/cm$^2$; distance between light source of ultraviolet irradiation apparatus and surface of elastic layer, 40 mm; and irradiation time, 180 seconds.

Regarding each of the development rolls thus obtained, the cross section in the circumferential direction was observed, and the thickness (d1) of the coating layer covering the convex portions of the rubber elastic layer, the thickness (d2) of the coating layer covering the flat portions of the rubber elastic layer, the height (h1) of the convex portions of the rubber elastic layer, the height of irregularities (h2) on the roll surface were measured using a laser microscope "VK-9510" manufactured by Keyence Corporation.

Furthermore, regarding each of the development rolls, adhesion between the rubber elastic layer and the coating layer, and the property of staining a photosensitive member with the development roll were evaluated. The evaluation methods are as follows.

(Adhesion)

A cross-cut adhesion test was carried out according to JIS K5400, in which, using a knife, the roll surface was provided with cross-cuts of 1 mm×1 mm (25 squares or more), a cellophane adhesive tape was applied to the area where the cross-cuts were made, and then the tape was peeled off. The case where no adhesion was observed on the peeled tape was evaluated to be "good" (indicated by open circle "○" in Tables 1 and 2 below), the case where adhesion occurred in one or more and less than five squares was evaluated to be "average" (indicated by open triangle "Δ"), and the case where adhesion occurred in five or more squares was evaluated to be "poor" (indicated by cross "x").

(Staining Property)

The development roll was incorporated into a commercially available color laser printer (LBP-2510 manufactured by Canon), and an image was continuously printed on 10,000 sheets (A4 size) at 32.5° C.×85% RH (i.e., an endurance test was carried out). The printer was left to stand for one week. Then, the cartridge was dismounted, and marking was performed on a portion of the photosensitive member with which the roll surface of the development roll is in contact. The cartridge was mounted again, and a solid image was printed. The case where no white spots occurred in the image at the marking position was evaluated be "good" (indicated by open circle "○"), the case where white spots slightly occurred only in the both ends of the image was evaluated to be "average" (indicated by open triangle "Δ"), and the case where white spots occurred in the image was evaluated to be "poor" (indicated by cross "x").

Furthermore, performance evaluation was performed on each of the development rolls. Specifically, the initial toner-conveying capability and the toner-conveying capability after an endurance test were evaluated. The evaluation methods are as follows.

(Initial Toner-Conveying Capability)

The amount of toner adhering to the roll surface was measured using a suction-type Faraday gauge method. That is, each of the development rolls was incorporated into a commercially available color laser printer ("LBP-2510" manufactured by Canon), and in an HH environment (32.5° C.×85% RH), while a solid black image is being printed, the printer was stopped. Subsequently, using a Faraday gauge, the toner adhering to the roll surface was sucked using a Faraday gauge. The toner-conveying amount (M/A) was calculated from the area of suction (A) and the suction amount (M). The case where the toner-conveying amount (M/A) was in the range of 4 to 7 g/m$^2$ was evaluated to be "pass" (indicated by open circle "○"), and the case where the toner-conveying amount (M/A) was out of the range of 4 to 7 g/m$^2$ was evaluated to be "failure" (indicated by cross "x").

(Toner-Conveying Capability after Endurance Test)

The toner-conveying amount (M/A) was calculated as in the evaluation of the initial toner-conveying capability except that, after an image was printed on 10,000 sheets (A4 size) in an HH environment (32.5° C.×85% RH), while a solid black image is being printed, the printer was stopped. The case where the toner-conveying amount (M/A) was in the range of 4 to 7 g/m$^2$ was evaluated to be "pass" (indicated by open circle "○"), and the case where the toner-conveying amount (M/A) was out of the range of 4 to 7 g/m$^2$ was evaluated to be "failure" (indicated by cross "x").

Figure 5:
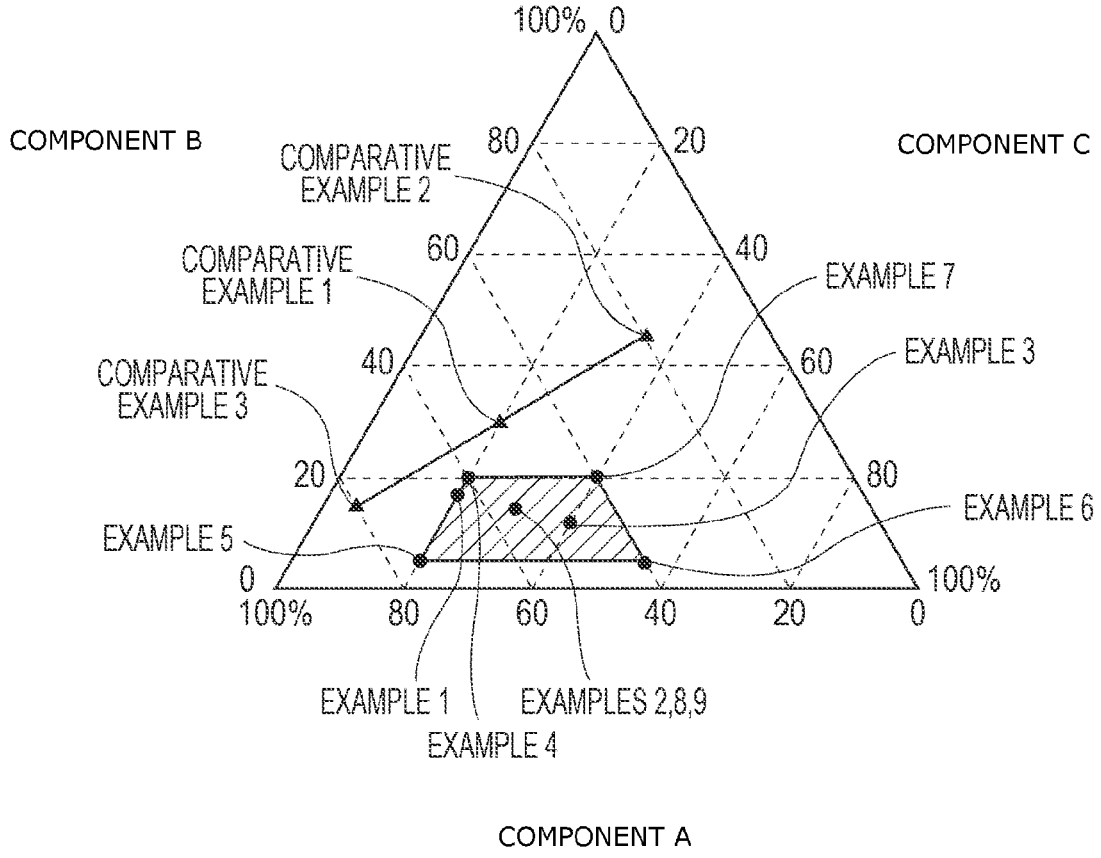
FIG. 5 is a ternary diagram in which the mass percentages of components (A), (B), and (C) in coating materials in Examples and Comparative Examples are plotted.

The composition ratios of coating layer compositions (coating materials) in the Examples and Comparative Examples and the evaluation results are shown in Tables 1 and 2. The composition ratios are expressed by parts by mass. Furthermore, FIG. 5 is a ternary diagram showing the composition ratio on the basis of 100 as the total of the thermoplastic urethane component, the polyol component, and the isocyanate component in each of Examples and Comparative Examples. Note that, in Examples 10 to 15, the composition ratio is the same as that in Example 2.

TABLE 1

| | | Example | | | | | |
|---|---|---|---|---|---|---|---|
| | | 1 | 2 | 3 | 4 | 5 | 6 |
| Coating layer position | | | | | | | |
| (A) Thermoplastic urethane | | 64 | 56 | 48 | 60 | 75 | 40 |
| (B) Polyol | | 16 | 14 | 12 | 20 | 5 | 5 |
| (C) Isocyanate | | 20 | 30 | 40 | 20 | 20 | 55 |
| Electronically conductive agent | | 30 | 30 | 30 | 30 | 30 | 30 |
| Ionically conductive agent | | 1 | 1 | 1 | 1 | 1 | 1 |
| Composition ratio c/b | | 1.3 | 2.1 | 3.3 | 1.0 | 4.0 | 11.0 |
| Thickness of coating layer | Convex portion d1 (μm) | 3.0 | 2.5 | 2.0 | 3.0 | 4.0 | 1.5 |
| | Flat portion d2 (μm) | 12.0 | 12.0 | 12.0 | 12.0 | 12.0 | 12.0 |

TABLE 1-continued

| | | | | | | |
|---|---|---|---|---|---|---|
| Height of convex portion of rubber elastic layer h1 (μm) | 20 | 20 | 20 | 20 | 20 | 35 |
| Height of irregularities on roll surface h2 (μm) | 8 | 8 | 8 | 8 | 8 | 13 |
| (A) Number-average molecular weight of thermoplastic urethane | 100000 | 100000 | 100000 | 100000 | 100000 | 100000 |
| (B) Number-average molecular weight of polyol | 2000 | 2000 | 2000 | 2000 | 2000 | 2000 |
| Surface protection layer | Not performed | Not performed | Not performed | Not performed | Not performed | Not performed |
| Surface modification | Not performed | Not performed | Not performed | Not performed | Not performed | Not performed |
| Evaluation | | | | | | |
| Adhesion | ○ | ○ | ○ | ○ | ○ | ○ |
| Staining property | ○ | ○ | ○ | ○ | ○ | ○ |
| Toner-conveying capability (initial) | ○ | ○ | ○ | ○ | ○ | ○ |
| Toner-conveying capability (after endurance test) | ○ | ○ | ○ | ○ | ○ | ○ |

| | | Example | | | Comparative Example | | |
|---|---|---|---|---|---|---|---|
| | | 7 | 8 | 9 | 1 | 2 | 3 |
| Coating layer composition | | | | | | | |
| (A) Thermoplastic urethane | | 40 | 56 | 56 | 50 | 20 | 80 |
| (B) Polyol | | 20 | 14 | 14 | 30 | 45 | 15 |
| (C) Isocyanate | | 40 | 30 | 30 | 20 | 35 | 5 |
| Electronically conductive agent | | 30 | 30 | 30 | 30 | 30 | 30 |
| Ionically conductive agent | | 1 | 1 | 1 | 1 | 1 | 1 |
| Composition ratio c/b | | 2.0 | 2.1 | 2.1 | 0.7 | 0.8 | 0.3 |
| Thickness of coating layer | Convex portion d1 (μm) | 1.5 | 2.5 | 2.5 | 2.0 | 0.5 | 4.0 |
| | Flat portion d2 (μm) | 12.0 | 12.0 | 12.0 | 12.0 | 12.0 | 12.0 |
| Height of convex portion of rubber elastic layer h1 (μm) | | 35 | 45 | 5 | 20 | 20 | 20 |
| Height of irregularities on roll surface h2 (μm) | | 13 | 25 | 1 | 8 | 8 | 8 |
| (A) Number-average molecular weight of thermoplastic urethane | | 100000 | 100000 | 100000 | 100000 | 100000 | 100000 |
| (B) Number-average molecular weight of polyol | | 2000 | 2000 | 2000 | 2000 | 2000 | 2000 |
| Surface protection layer | | Not performed | Not performed | Not performed | Not performed | Not performed | Not performed |
| Surface modification | | Not performed | Not performed | Not performed | Not performed | Not performed | Not performed |
| Evaluation | | | | | | | |
| Adhesion | | ○ | ○ | ○ | Δ | Δ | X |
| Staining property | | ○ | ○ | ○ | Δ | X | X |
| Toner-conveying capability (initial) | | ○ | ○ | ○ | ○ | ○ | ○ |
| Toner-conveying capability (after endurance test) | | ○ | ○ | ○ | ○ | ○ | ○ |

TABLE 2

| | Example | | | | | | |
|---|---|---|---|---|---|---|---|
| | 2 | 10 | 11 | 12 | 13 | 14 | 15 |
| Coating layer composition | | | | | | | |
| (A) Thermoplastic urethane | 56 | 56 | 56 | 56 | 56 | 56 | 56 |
| (B) Polyol | 14 | 14 | 14 | 14 | 14 | 14 | 14 |
| (C) Isocyanate | 30 | 30 | 30 | 30 | 30 | 30 | 30 |
| Electronically conductive agent | 30 | 30 | 30 | 30 | 30 | 30 | 30 |
| Ionically conductive agent | 1 | 1 | 1 | 1 | 1 | 1 | 1 |
| Composition ratio c/b | 2.1 | 2.1 | 2.1 | 2.1 | 2.1 | 2.1 | 2.1 |
| Thickness of coating layer: Convex portion d1 (μm) | 2.5 | 2.5 | 2.5 | 2.5 | 2.5 | 2.5 | 2.5 |
| Thickness of coating layer: Flat portion d2 (μm) | 12.0 | 12.0 | 12.0 | 12.0 | 12.0 | 12.0 | 12.0 |
| Height of convex portion of rubber elastic layer h1 (μm) | 20 | 20 | 20 | 20 | 20 | 20 | 20 |
| Height of irregularities on roll surface h2 (μm) | 8 | 8 | 8 | 8 | 8 | 5 | 8 |
| (A) Number-average molecular weight of thermoplastic urethane | 100000 | 50000 | 200000 | 100000 | 100000 | 100000 | 100000 |
| (B) Number-average molecular weight of polyol | 2000 | 2000 | 2000 | 500 | 4000 | 2000 | 2000 |
| Surface protection layer | Not performed | Not performed | Not performed | Not performed | Not performed | Performed | Not performed |
| Surface modification | Not performed | Not performed | Not performed | Not performed | Not performed | Not performed | Performed |
| Evaluation | | | | | | | |
| Adhesion | ○ | ○ | ○ | ○ | ○ | ○ | ○ |
| Staining property | ○ | ○ | ○ | ○ | ○ | ○ | ○ |
| Toner-conveying capability (initial) | ○ | ○ | ○ | ○ | ○ | ○ | ○ |
| Toner-conveying capability (after endurance test) | ○ | ○ | ○ | ○ | ○ | ○ | ○ |

In the Comparative Examples, since the composition ratios of the thermoplastic urethane, the polyol, and the isocyanate in the coating material constituting the coating layer are out of the specific ranges, adhesion between the rubber elastic layer and the coating layer is poor. Furthermore, after the endurance test, the convex portions of the rubber elastic layer were broken, and the image defect of white spots occurred in the solid image printed after the endurance test. Consequently, it has been found that the photosensitive member is highly stained in the Comparative Examples.

In contrast, in the Examples, since the composition ratios of the thermoplastic urethane, the polyol, and the isocyanate in the coating material are in the specific ranges, and the thixotropy is high. It has been confirmed that, after the coating material is applied onto the rubber elastic layer, the viscosity increases immediately, and the thickness of the coating layer is prevented from decreasing at the apexes of the convex portions and at the sloping surfaces of the convex portions of the rubber elastic layer. Specifically, the thickness of the coating layer covering the convex portions of the rubber elastic layer was 1.5 μm or more. Furthermore, it has been confirmed that adhesion between the rubber elastic layer and the coating layer is excellent. Furthermore, breakage of the convex portions of the rubber elastic layer was not observed after the endurance test, and the image defect of white spots did not occur in the solid image printed after the endurance test. Consequently, it has been confirmed that, in the Examples, the photosensitive member is not stained after the endurance test. Furthermore, according to the development rolls in the Examples, it has been confirmed the initial toner-conveying capability and the toner-conveying capability after the endurance test are also excellent.

Note that, in FIG. 5, the symbol "●" (solid circle) represents an example, and the symbol "▲" (solid triangle) represents a comparative example. According to FIG. 5, it has been confirmed that the Examples fall within the region (shaded region) surrounded by lines connecting the points (60,20,20), (75,5,20), (40,5,55), and (40,20,40) in the ternary diagram, and the Comparative Examples fall outside the shaded region.

Although the embodiments of the present invention have been described in detail, it should be understood that the present invention is not limited to the embodiments described above, and that various changes and alterations can be made without departing from the spirit and scope of the present invention.

What is claimed is:

1. A development roll for electrophotographic equipment, comprising:

a shaft body;

a rubber elastic layer formed by molding on an outer circumference of the shaft body and having a plurality of convex portions formed by transfer molding on the outer circumferential surface thereof; and a coating layer disposed on an outer circumference of the rubber elastic layer, wherein the coating layer comprises a cured body of a coating material comprising (A) a thermoplastic urethane having a number-average molecular weight in the range of 50,000 to 200,000, (B) a polyol having a number-average molecular weight in the range of 500 to 4,000, and (C) a curing agent; and wherein the mass percentages a, b, and c of the components (A), (B), and (C) in the coating material satisfy the following expressions: $a+b+c=100$, $40 \leq a \leq 75$, $5 \leq b \leq 20$, and $20 \leq c$.

2. The development roll for electrophotographic equipment according to claim 1, wherein the thickness of the coating layer covering the convex portions of the rubber elastic layer is 1.5 μm or more.

3. The development roll for electrophotographic equipment according to claim 2, wherein the height of irregularities on the roll surface is in the range of 1 to 25 μm.

4. The development roll for electrophotographic equipment according to claim 3, wherein the height of the convex portions of the rubber elastic layer is in the range of 2 to 50 μm.

5. The development roll for electrophotographic equipment according to claim 2, wherein the height of the convex portions of the rubber elastic layer is in the range of 2 to 50 μm.

6. The development roll for electrophotographic equipment according to claim 1, wherein the height of irregularities on the roll surface is in the range of 1 to 25 μm.

7. The development roll for electrophotographic equipment according to claim 6, wherein the height of the convex portions of the rubber elastic layer is in the range of 2 to 50 μm.

8. The development roll for electrophotographic equipment according to claim 1, wherein the height of the convex portions of the rubber elastic layer is in the range of 2 to 50 μm.

* * * * *